US009976775B2

(12) United States Patent
Stebbins et al.

(10) Patent No.: US 9,976,775 B2
(45) **Date of Patent: *May 22, 2018**

(54) REMOTELY CONTROLLED WATER HEATER SYSTEM

(71) Applicants: Micheal D. Stebbins, Scottsdale, AZ (US); Steve Lurcott, Lighthouse Point, FL (US); Todd Kenneth Roper, Glendale, AZ (US); Larry Martin, Colorado Springs, CO (US); Brian Keith Roper, Phoenix, AZ (US)

(72) Inventors: Micheal D. Stebbins, Scottsdale, AZ (US); Steve Lurcott, Lighthouse Point, FL (US); Todd Kenneth Roper, Glendale, AZ (US); Larry Martin, Colorado Springs, CO (US); Brian Keith Roper, Phoenix, AZ (US)

(73) Assignee: BOLLENTE COMPANIES INC., Scottsdale, AZ (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/130,960

(22) Filed: Apr. 16, 2016

(65) Prior Publication Data

US 2016/0231022 A1 Aug. 11, 2016

Related U.S. Application Data

(63) Continuation of application No. 14/588,190, filed on Dec. 31, 2014, now Pat. No. 9,341,391.
(Continued)

(51) Int. Cl.
*H05B 1/02* (2006.01)
*F24H 9/20* (2006.01)
(Continued)

(52) U.S. Cl.
CPC ..... *F24H 9/2028* (2013.01); *F24D 17/0026* (2013.01); *F24D 19/1051* (2013.01);
(Continued)

(58) Field of Classification Search
CPC ..... F24H 9/20; F24H 1/10; F24H 1/22; F24H 1/102; F24H 1/225; F24D 17/00; F24D 19/10; F24D 17/0026; F24D 19/1051
See application file for complete search history.

(56) References Cited

U.S. PATENT DOCUMENTS 9,341,391 B2 * 5/2016 Stebbins ..... F24H 9/2028

* cited by examiner

*Primary Examiner* — Brian Jennison
(74) *Attorney, Agent, or Firm* — Parsons & Goltry; Robert A. Parsons; Michael W. Goltry

(57) ABSTRACT

This invention relates primarily to an electric heater based tankless water heater, though some aspects may also apply to a natural gas or other fuel based tankless water heater. In particular aspects relating to "smart" communication and coordination of the tankless water heater with other devices, which may be electrically powered or powered by other fuels, may also apply to non-electric flow through fluid heating systems. The subject tankless water heater invention incorporates several aspects relating to energy and construction efficiency which will be detailed further. These include both physical aspects, such as coatings, tubing and heater element design, and electrical aspects, such as power control for individual heater elements, which can make the tankless water heater more compact and more efficient in operation, with reduced instantaneous and long term load on electrical supply systems.

34 Claims, 8 Drawing Sheets

Related U.S. Application Data

(60) Provisional application No. 61/922,493, filed on Dec. 31, 2013.

(51) Int. Cl.

| | |
|---|---|
| ***F24H 1/10*** | (2006.01) |
| ***F24H 1/22*** | (2006.01) |
| ***F24D 17/00*** | (2006.01) |
| ***F24D 19/10*** | (2006.01) |

(52) U.S. Cl.

CPC ..... *F24H 1/102* (2013.01); *F24H 1/225* (2013.01); *F24D 2200/08* (2013.01)

REMOTELY CONTROLLED WATER HEATER SYSTEM

CROSS REFERENCE TO RELATED APPLICATIONS

This is a Continuation application, taking priority from Provisional application 61/922,493 filed Dec. 31, 2013 and Utility application Ser. No. 14/588,190 filed Dec. 31, 2014.

BACKGROUND OF THE INVENTION

References

U.S. Pat. No. 7,046,922, William R. Sturm et. al., Modular Tankless Water Heater U.S. Pat. No. 7,088,915, William R. Sturm et. al., Modular Tankless Water Heater U.S. Pat. No. 7,164,851, William R. Sturm et. al., Modular Tankless Water Heater U.S. Publication # US 2008/0285964, Joseph M. Sullivan, Modular Heating System for Tankless Water Heater U.S. Pat. No. 8,165,461, Joseph M. Sullivan, Modular Heating System for Tankless Water Heater The invention described herein relates generally to a tankless water heater system. In such a system, water is heated as it flows through the system, as opposed to a standard household or industrial water heater in which water is kept heated at all times in a tank, and the heater does not have the capacity to heat the water quickly enough to satisfy potential demand. Potential disadvantages of a tank based water heater include large size, because a substantial amount of water must be kept hot to satisfy potential demand, energy inefficiency since water is kept hot even when it may not be used for many hours, and water deposits due to large amounts of slowly moving water which may cause corrosion and leakage of the tank. In addition, despite being sized for expected use, it is not an uncommon occurrence for demand to exceed the supply, such as if many people take showers in a row, and thereby for the water heater to run out of hot water.

A tankless water heater system in general solves these problems, but have challenges relating to fine levels of control of heated water if flow levels are low. In the case of electrically heated models in particular, very high power burdens are put on local circuits within a building, both in the form of transients and steady state. High burdens are also placed on regional power grids.

SUMMARY DISCLOSURE OF INVENTION

Tankless water systems provide solutions to the potential problems of tank water heaters, as they are compact and heat water on demand, only when it is needed. Tankless water heaters typically use either natural gas or electricity to heat the water as it flows through. This invention relates primarily to an electric heater based tankless water heater, though some aspects may also apply to a natural gas or other fuel based tankless water heater. In particular aspects relating to "smart" communication and coordination of the tankless water heater with other devices, which may be electrically powered or powered by other fuels, may also apply to non-electric flow through fluid heating systems. The subject tankless water heater invention incorporates several aspects relating to energy and construction efficiency which will be detailed further below.

Note that although this application discusses the subject invention primarily in terms of its use with a Tankless Water Heater used to heat water, such as found in many homes, the subject invention is clearly usable with any type of liquid heating system, in which high heat capacity of the liquid causes need for a high power heater whose power consumption must thereby be monitored and controlled. Industrial processes in particular may use such heaters and control systems. For purposes of this invention, water is considered equivalent to fluid or liquid, and may refer to any mixtures of liquids, colloids and solids, capable of flowing via gravity or being pumped. Said liquids may contain dissolved gasses or solids. In an exemplary embodiment, said liquid is primarily water. Similarly, Tankless Water Heater is intended to refer to any flow through fluid heater. Any embodiments herein described may be combined in part or in whole with other embodiments as appropriate to develop the complete tankless fluid heating system.

One embodiment of this invention uses a system of horizontally laid out tubes through which fluid flows, at least one with a heating element inside, with temperature and flow sensors and a control system such that an appropriate amount of heat can be supplied to the fluid by means of the heating element or elements such that the water is heated as it flows in series through each of the tubes to a desired temperature. The tubes may have interior baffle structures intended to improve heat transfer from the one or more heating elements in the tubes to the fluid by means of providing cavitation, turbulence and mixing of the fluid. These horizontally laid out tubes help to improve flushing of the tubes as fluid flows through and reduces accumulation of sediment. Note that this invention is not restricted to horizontal tubes, and may be employed with vertical tubes as well. These tubes and/or these baffle structures may be primarily comprised of stainless steel, aluminum, copper, ceramic or plastic.

Another embodiment of this invention involves staggering horizontal or vertical tubes, so that rather than being completely parallel to each other and thereby lying in a single plane as viewed from one end, they "zig-zag", such that more tubes can be fit in a smaller layout within the plane by rising in and out of the plane.

Another embodiment of this invention involves coating the heat transfer tubes with some material to sustain or enhance heat transfer while protecting from corrosion. In a preferred embodiment, this coating material may be a ceramic.

Another embodiment of this invention involves one or more safety relays which cuts power to a shorted or non-functional heating element. Such a relay may be controlled by systems including, but not limited to, mechanical relays, solid state relays, or integrated circuits.

Another embodiment of this invention includes a control system which can monitor operation of one or more heating elements and/or fluid flow sensors, looking for failure or anomalous operation of these components. In a further embodiment, data on routine operation of these components may be recorded, such as, but not limited to values for parameters like fluid flow, temperature, wattage, hours of operation, and so on. In a further embodiment, data can be logged, or recorded automatically, at intervals which may be adjusted. In a further embodiment, data can be transmitted by wired or wireless systems to recipients such as, but not limited to, the user, the distributor of the tankless heater, the manufacturer of the tankless heater, a service center for the tankless heater, or a control system for other process equipment which may be connected to or rely on the operation of the tankless heater.

Another embodiment of this invention may include power management. The control system for the tankless heater may monitor and adjust for incoming voltage. A further embodiment of a Smart control system may also communicate by wired or wireless circuits with other control systems. These control systems may include, but are not limited to, those belonging to the power company, other tankless heater units of the same or other types, industrial control systems, and other "smart" enabled devices which have significant electric power demand such as refrigerators, air conditioners, baseboard heaters, and clothes dryers. This communication may be for reasons including, but not limited to, local load balancing to prevent circuit overload, or grid load balancing in which a user may get a credit from the power company for reducing demand at appropriate times.

This Electric Tankless Heater provides these and other advantages over other tankless heater systems which may have been previously developed.

DETAILED DESCRIPTION

Mode(s) for Carrying Out the Invention

The present invention and some of its various embodiments are described below, with reference to figures as necessary. Reference numbers are used to match particular elements described in the text with those shown in figures.

Generally speaking, the present invention describes an apparatus and associated methods of construction and operation for tankless heating of a fluid or liquid. Although aspects could apply to any method for providing thermal energy to the tankless heating system, such as but not limited to steam, hydrocarbon or hydrogen fuel, or other heat transfer fluids, it most particularly relates to a tankless heating system based on electric resistance based heating elements and exemplary embodiments will be based on this thereby.

Figure 1:
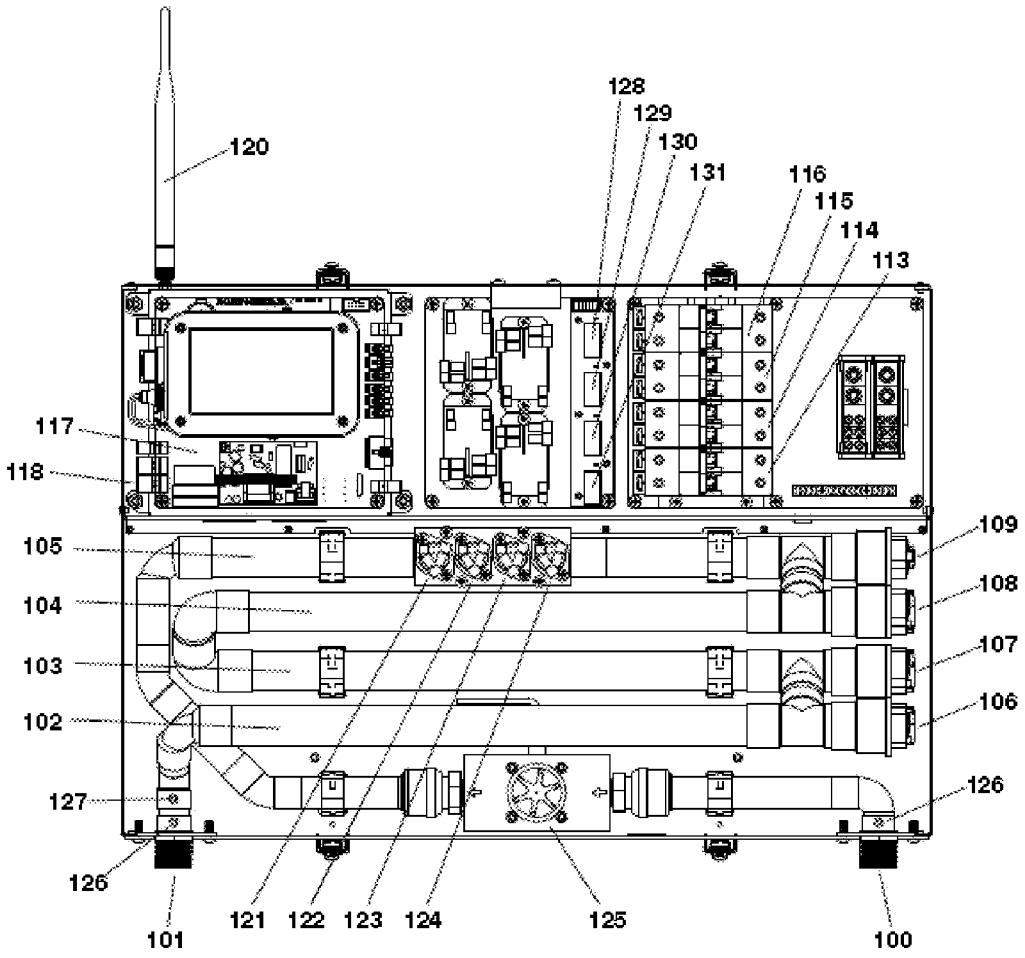
FIG. 1 illustrates a front view of the tankless heater system, showing the control electronics, heater elements and water path through tubing.

FIG. 1 illustrates a tankless heater system, as constructed in accordance with the invention described herein. The apparatus includes a fluid inlet 100, a fluid outlet 101, and at least one tube for heating fluid 102. The fluid inlets 100 and 101 would terminate in standard plumbing fittings as appropriate for the particular application, such as, but not limited to, NPT, compression fittings, or Swagelock fittings, in sizes appropriate for the intended fluid and flow rate. Additional tubes for heating fluid 103, 104 and 105 are shown, as would be apparent to one skilled in the art the number of tubes used could vary depending on a variety of factors such as, but not limited to, tube diameter and length, heater size, heater power available, fluid heat capacity, fluid flow rate, and temperature range the fluid must be heated through. A larger number of tubes allows for more effective heating of fluid at a given flow rate, but also requires more materials for construction and more space for the complete system. The tube for heating fluid 102 has at least one heating element terminal 106, which connects to a heating element which extends into the interior of the tube 102. In this embodiment a separate heating element terminal 107, 108 and 109 is used for each tube 103, 104 and 105, but it would also be possible with other configurations to share common heating element terminals across multiple tubes, or to have multiple heating element terminals for each tube.

Figure 2:
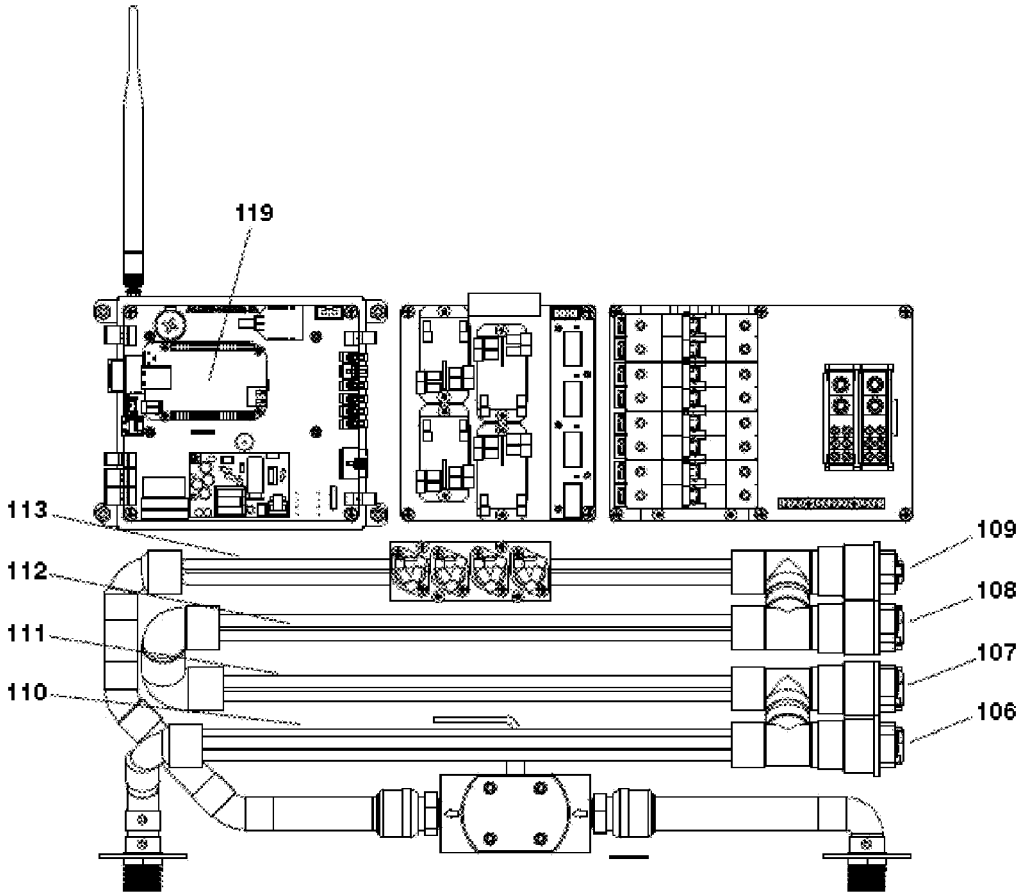
FIG. 2 illustrates a front view of the tankless heater system, showing a heater element in a tube.

FIG. 2 shows an exemplary heating element terminal 106 which electrically connects to a heating element 110 which would be inside tube 102 (FIG. 1). Similarly, tube 103 may have heating element terminal 107 electrically connected to heating element 111, tube 104 may have heating element terminal 108 electrically connected to heating element 112, and tube 105 may have heating element terminal 109 electrically connected to heating element 113. While the heating element 110 shown is a simple curved resistance element, in other embodiments of this invention the heating element may have more complex shapes. It is desirable, though not required for purposes of this invention, to use large surface area heater elements relative to the interior tube cross section to reduce the watts per square inch heating density, or "watt density", of the heater element. This helps to reduce scaling and chance of water boiling at the surface of the heater element. Of course, this must be balanced with the increased tube cross section such a larger surface area heating element would occupy, thereby raising fluid back pressure of the flow-through system.

Similarly, interior baffles such as, but not limited to, helixes, bumps, spirals, periodic patterns, randomized patterns, open celled foam, subtubes, or columns, which may be attached to the heating element, attached to the tube wall, inserted into the space between the heating element and a tube wall, or any combination thereof, may be utilized as well. These more complex heating element shapes and/or interior baffle structures are intended to improve heat transfer from the heating element in the tube to the fluid by means of providing cavitation, turbulence and mixing of the fluid, though the baffles may also serve other purposes such as, but not limited to, acting as spacers between the heating elements and the tube walls. Such baffles may be used in one or more tubes 102, 103, 104 and 105 as shown in FIG. 1, and may be constructed of materials such as, but not limited to, aluminum, copper, stainless steel, ceramic or plastic.

In another embodiment the baffles may be constructed of multiple materials, for example columns extending between the heating element 110 and the inner wall of the tube 102 may be constructed primarily of a high heat conducting material such as metal, with the last portion constructed of a low heat conductivity material such as plastic so that heat from the heating element is not transferred as easily to the tube wall, heating the entire tankless heater enclosure. Other locations in the heat transfer system for use of such specialized configurations are evident to one skilled in the heat transfer arts.

In another embodiment it may be desirable to construct any of the heating element, baffle, or tubing out of inexpensive materials which are less corrosion resistant and coat any or all of them on the inside or the outside with a more expensive or durable material which may be more corrosion resistant. This allows use of an inexpensive material such as, but not limited to, a metal like aluminum or copper which may be a good heat conductor and preventing reaction of the metal with water, i.e. corrosion, by coating it with a less thermally conductive but more chemically resistant material such, but not limited to, epoxy, plastic resin or ceramic.

In another embodiment it may be desirable to coat the outside of tubes 102, 103, 104 and 105 with a material to reduce heat loss from them. This both reduces the power needed by the tankless heater system, and improves safety by reducing exterior temperatures of the tubes. Such a material should be a thermal insulator such as, but not limited to, ceramic, paint or plastic. Such a material may be porous, comprising an open celled foam, a closed cell foam, a fibrous material, or a felted material, thereby providing more insulation per unit thickness. It may also be multilayered in nature. In one embodiment, this may comprise an underlayer of ceramic against the hot tube surface, an overlayer of resin or paint for appearance and protection of the more fragile ceramic, and a final layer of fiberglass for insulation. In a particular embodiment the undermost layer may be ceramic, and may be between 0.1 and 2 mils in thickness. In a preferred embodiment the undermost layer may be ceramic and may be between 0.5 and 1.0 mil in thickness. In a preferred embodiment the ceramic coating layer may comprise Cerakote C-217Q.

As shown in the exemplary embodiment of FIG. 1, it is desirable to put the electronics above the water containing portion of the tankless heater system. These electronics may contain such items as a set of circuit breakers 113, 114, 115, and 116 for various heating elements such as 110, 111, 112 and 113, with each circuit breaker corresponding to one heating element. The electronics may include a Tankless Water Heater or TWH control system 117 which manages the overall tankless heater system, a plug connector 118 for transmitting data by wire back and forth from the tankless heater system to other systems of various types, a wireless transmission unit 119 (FIG. 2) which sends data back and forth from the tankless heater system to other systems of various types, and an antenna 120 which allows the wireless transmission unit 119 to transfer this data. The electronics may include transformers (not shown) which provide up conversion or down conversion of voltages, either for heater power or powering low voltage electronic components in the TWH control system 117 or data communications systems 118 and 119.

Components which the TWH control system 117 may control or collect data from include power control units 121, 122, 123, and 124 for the heater elements 110, 111, 112 and 113, with one power control unit providing variable power to each corresponding heater element, thereby providing a fine degree of control over power and temperature profiles of the heating sections of the tankless heater system. These power control units 121-124 may comprise mechanical relays, solid state relays, TRIACs, Variacs, SCRs, and other power control units as are familiar to those skilled in the electric heater operation field. In addition to being a controllable means of varying power to resistance heater elements, they may provide data back to the TWH control system 117 on performance parameters such as percent of full power operation, point in an AC cycle at which they are triggering, and so on. Other components include a water flow sensor 125, of types which may include, but are not limited to, "paddlewheel" or turbine type sensors, ultrasonic sensors, optical sensors, differential pressure sensors such as Venturi sensors, and thermal mass flow sensors. It may be desirable to use more than one type of flow sensor if it is desirable to measure across a wide range of flows, or with varying levels of precision. Other components include at least one temperature monitor 126, which may be used to measure incoming fluid temperature, exit fluid temperature, or both if two temperature monitors are used. These temperature monitors can be in the form of, but are not limited to, thermocouples, thermistors, infrared detectors, or Resistance Temperature Detectors (RTDs). Finally, a thermal cutout switch 127 may be used for safety operations such as to ensure that if no water is present heaters cannot be operated. The flow sensor 125 may also function as a safety device, or an additional flow switch (not shown) may be used as such, since it could be dangerous to heat the fluid in the system if it is not flowing. It is desirable, though not required for purposes of this invention, for safety devices to be independent of the control system 117 such that even if the control system is not functioning properly, the unit will be safely shut down.

In a preferred embodiment power control units 121, 122, 123, and 124 get instantaneous information about the current driving each heating element 110, 111, 112 and 113 by using current sensors 128, 129, 130 and 131. These current sensors can potentially monitor AC cycle point, amplitude and waveform, and by sending this data back to the TWH control system 117 allow for individual heater element control. This feature allows for controlled "derating" of a TWH unit by software or firmware adjustments to permit its installation when available electrical service might not be sufficient for full power operation. Thus, for example, if the physical hardware is capable of driving 160 Amps, firmware for a particular TWH model could be set for a maximum of 120 Amps, and heater current would be controlled in a PID feedback mode around the value of 120 Amps. This firmware data can be stored in a system including, but not limited to, nonvolatile memory in a SDHC card, which allows setting the configuration or model number either during production or in a post production retrofit or upgrade. The current sensors also allows for cutting out an individual heater element while continuing to drive the others if any malfunction is noted in that element, such as current draw during a "power off" cycle, or low or high current use during a "power on" cycle, and potentially reporting that failure and setting status flags in control system 117. Either the user or servicer of the TWH unit can also be notified. Meanwhile, any other remaining "good" heater elements can continue to be used, and the control algorithm adjusted to split AC cycles across, for example, three instead of four elements, with 33.3% of the cycles instead of 25% of the cycles going to each element. Finally, startup of the heaters can be delayed based on how long the unit has been idle since last use, with longer times, up to several minutes, potentially used if the unit has not been used for hours. No startup lockout might be needed if the unit has been off for less than a few minutes.

In a typical mode of operation of this TWH system the temperature of incoming fluid is measured and the flow rate of the fluid is measured. This information is used to calculate power that needs to be supplied to one or more resistance heating elements past which fluid flows to heat the fluid to a temperature set point which has been entered into the control system. Higher flow of fluid or lower entry temperature will require more power for the heaters to reach the desired temperature set point. Temperature of the outgoing fluid is measured, and this information used in a feedback loop to adjust power used by the system to heat the fluid.

In a preferred embodiment of this invention, the Tankless Water Heater control system 117 monitors AC cycles, and portions out these cycles among the heaters 110, 111, 112 and 113, to reduce instantaneous power demand of the system. One example of how this could be done is to allow a first AC cycle to go to heater 110, the next to heater 111, the next to heater 112, the next to heater 113, and the next back to heater 110. After a time interval which could be preset or user adjustable, a first AC cycle could go to both heaters 110 and 111, the next to heaters 112 and 113, and the next back to heaters 110 and 111. Any combination of heaters may be partially or fully powered at any time, thereby balancing load in accordance with priorities set for the system. By ramping up the power on condition of the heaters, which are a large current drain, this could reduce flicker or transient brown-out conditions on other electrical devices on the same circuit as the Tankless Water Heater by allowing time for loads to rebalance across the circuits. Similarly, ramping down the power off condition of the heaters can help prevent voltage surges to other electrical devices on the same circuit as the Tankless Water Heater. Other specific ramp up, steady state and ramp down modes of allocating AC cycles, including use of partial cycles and cycles which are in phase or out of phase, are intended to be within the scope of this invention.

In another embodiment of this invention, the Tankless Water Heater would use Phase Angle Control or Phase Fired Control (PFC) to provide power to the heaters 110, 111, 112 and 113, to reduce instantaneous power demand of the system. A PFC controller turns on AC input at a particular point in each AC cycle's waveform, synchronizing with the waveform in order to maintain consistent power output. If a different power output is needed, the phase chosen for AC cycle turn-on can be continuously changed, adjusting power delivered. With solid state digital type control systems, power may also be adjusted in steps, of a step size dependent on the resolution of the digital input.

Figure 3:
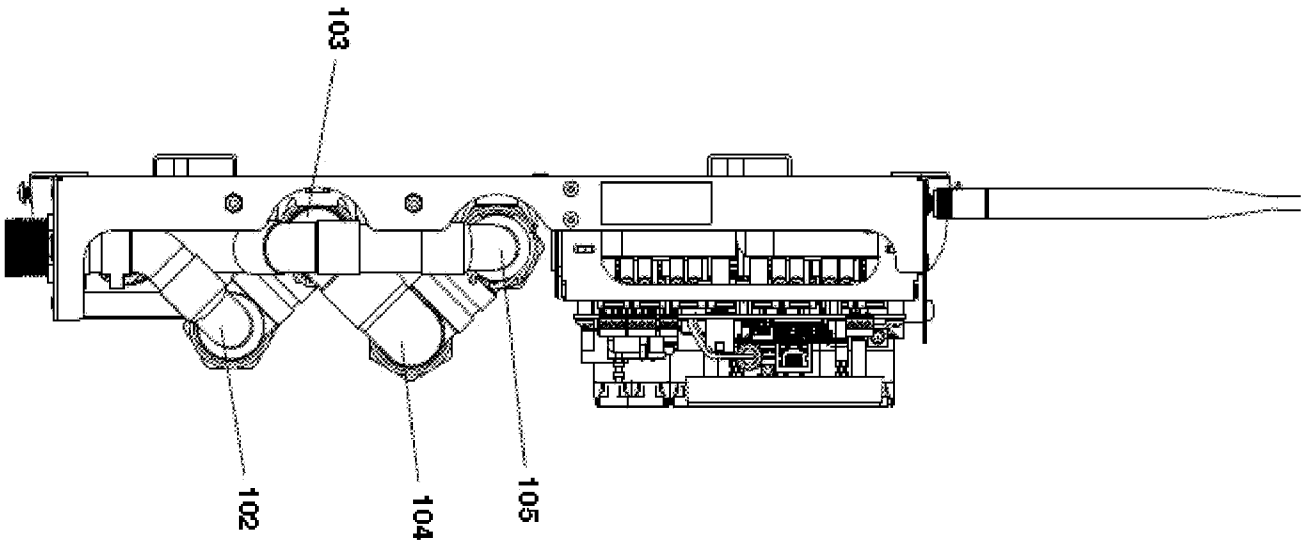
FIG. 3 illustrates a side view of the tankless heater system, showing the control electronics, heater elements and water path through tubing.
Figure 4:
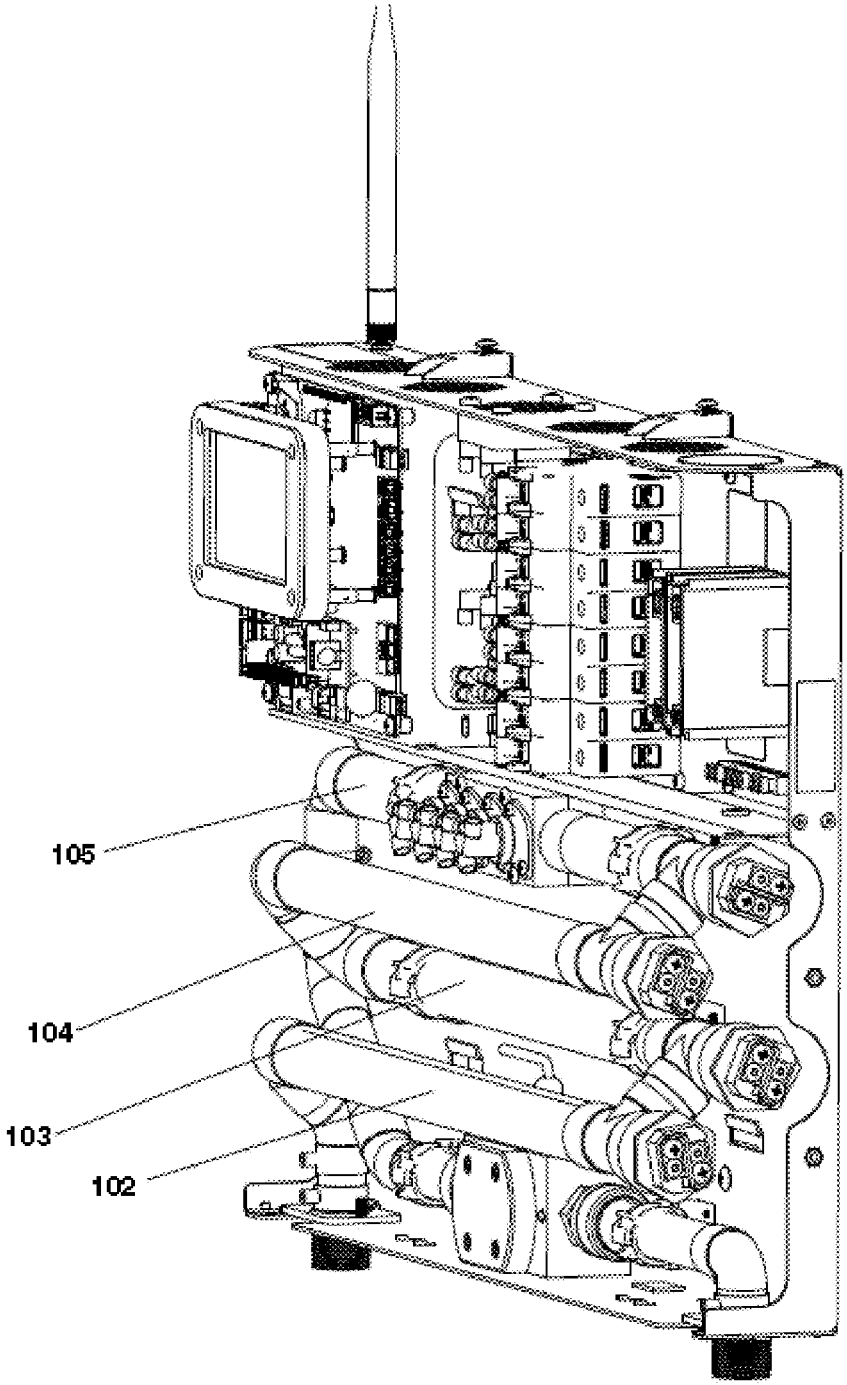
FIG. 4 illustrates a three-quarter view of the tankless heater system, showing the control electronics, heater elements and water path through tubing.

A side view of an embodiment of this invention is seen in FIG. 3, with a three-quarters view in FIG. 4, each of which shows the staggered or "zig-zag" layout of the tubes 102, 103, 104 and 105, taking them out of the general plane of the overall apparatus. It can be seen that this reduces the vertical space needed for the overall unit, and since the electronics require a certain amount of horizontal space in any case the total volume occupied by the unit is thereby reduced. In general tankless heater systems are particularly desirable for locations with limited space, since they do not need bulky tanks. Note that in this embodiment all heater elements are inserted from one side (in this case the right side) of the tubes 102, 103, 104 and 105 despite the fact that they are in a serpentine layout. This allows for more compact servicing of the unit if heater elements need to be replaced, since additional space for removal and insertion of long heater elements only needs to be allowed on one side of the TWH system. The design of this unit also allows all water flow tubes 102, 103, 104 and 105 and connections to be approximately the same diameter.

Figure 5A:
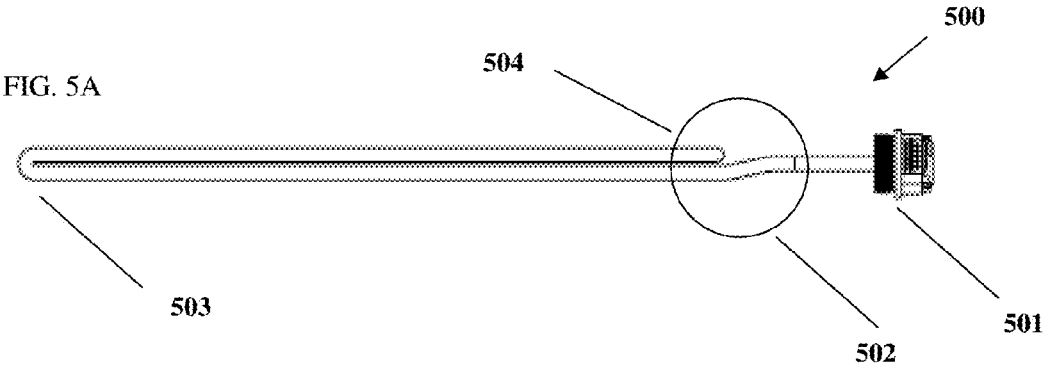
FIG. 5A illustrates a heating element with "kink" to allow concentric insertion into a tube.
Figure 5B:
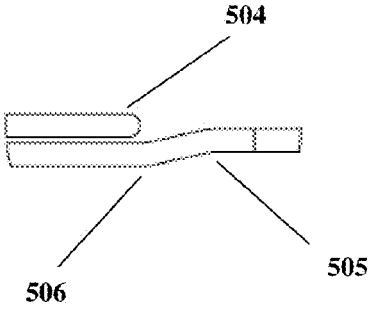
FIG. 5B illustrates a magnified view of the heating element "kink" in profile.
Figure 5C:
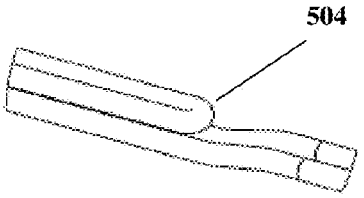
FIG. 5C illustrates a magnified view of the heating element "kink" in perspective.

FIG. 5A shows an embodiment of a more complex heater element shape. Near where the screw thread fitting 500 allows waterproof fastening of the heater element 500 in the water tube such as 102, a double bend, or "kink" can be seen in the heater element. This allows the heater element to double back on itself at bend 503, allowing for a longer total heater length and thereby lower watt density, and end at 504 near the "kink" 502. FIG. 5B, in cross section, and FIG. 5C, in perspective, show a closeup of this double bend or "kink" 502, with bend down 505 and second bend 506 which straightens out the heater element to extend into the water tube such as 102, allowing the heater element to double back on itself at the far end of the water tube and return to end at 504 while retaining concentricity, which keeps the heater element from touching the walls of the water tube. This additional heater length offers several advantages. First, it allows for lower watt density of the heater, which reduces scaling on the surface of the heater element. Second, the four heater element cross sections inside each water tube cross section beyond the "kink" increases the percentage of cross section of each water tube 102, 103, 104 and 105 which is occupied by each heater element 110, 111, 112 and 113. In a particular embodiment of this invention, the percentage of the cross section of each water tube which is occupied by heater element may be between 25% and 50%, or, preferably between 35% and 40%. The reduced percentage of water heating tube 102, 103, 104 and 105 cross section which is occupied by water allows the total water volume in the TWH system to be reduced, to potentially as little as a liter, which means the instant TWH system can measure water flow and heat water effectively even at fairly low water flow rates, something which has proved challenging for other tankless water heater systems.

Figure 6:
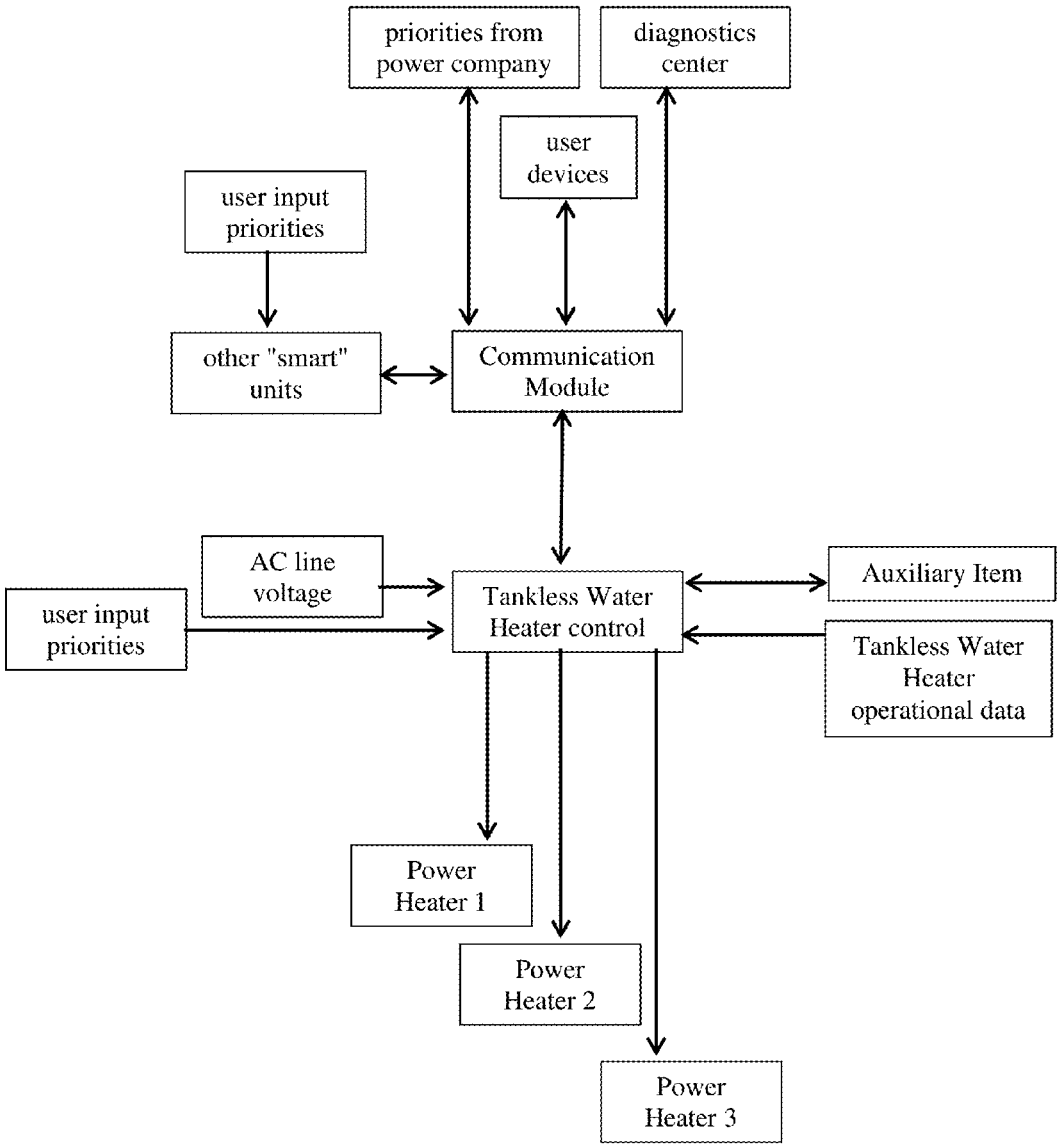
FIG. 6 illustrates a flow chart for a control system for the tankless heater system, showing data logging, transmission, communication and coordination with other "smart" control systems.

In an embodiment of this invention shown in FIG. 6 the Tankless Water Heater, or TWH, control system is capable of a variety of sophisticated monitoring and control functions. For example, the Tankless Water Heater control system may monitor incoming AC voltage, observing whether it is 110 VAC, 208 VAC, 220 VAC, and so on for other common incoming AC voltages available in a household or industrial setting. Based on the voltage available, the system could adjust how it operates in ramp up, steady state, and ramp down power modes to optimize performance and reduce disturbance to other electrical devices on the circuit. In order to carry out these monitoring and control functions, the TWH includes at least one logic processing circuit and at least one memory circuit such that operating parameters for the apparatus can be stored in the memory circuit and the apparatus can be controlled by the logic processing circuit. These logic and memory circuits may be on separate integrated circuits, or may be combined on one integrated circuit. Each of the logic and memory circuits may be further subdivided onto separate integrated circuits such as, but not limited to, a case whereby there may be both volatile and nonvolatile memory in the TWH control system.

In other embodiments, data on how the system is performing may be collected from sensors such as, but not limited to, those discussed elsewhere, for example flow sensors 125 and temperature monitors 126. Safety devices such as a temperature cutout 127 or a leak detector (not shown), in the interior case of the system or below or near it in event of external leaks, may also be monitored. Logging of data may include factors such as water flow, including but not limited to minimum, maximum, average, and total flow, since install or since last reset. Logging may include factors such as temperature, including but not limited to incoming water, outgoing water, set point, heater core temperature, heater outside temperature, or case temperature. Logging may include factors such as wattage, including but not limited to hourly, daily, weekly, monthly, peak load, and since last power company billing cycle. In addition to using this information for optimizing system operation, the data may be logged, may be displayed on a readout for the TWH control system, and/or may be communicated to a Communications Module. The user can enter priorities into the TWH control system, such as, but not limited to, how much power the unit is allowed to draw, how much priority it should get on circuit power relative to other "smart" or enabled electrical devices, and what operations it may perform based on communications from the power company. Different users may have different permissions to change certain operating parameters for the TWH system, for example the installer may have permission to change a safety cut-out point, while the user may not have this permission if the cut-out point is dictated by local building code.

The TWH Control System sends signals to adjust Power Heater 1, Power Heater 2, Power Heater 3, and so on for any number of heaters which may be in use in the overall TWH system. These signals can take a variety of forms, including the full AC power needed to drive the heaters. In a preferred embodiment, these are low voltage signals which go to TRIACs, each of which can adjust power cycle by cycle to each heater as described elsewhere. The TWH Control System may also exchange signals bidirectionally with an Auxiliary Item, which may include, but is not limited to, a water shutoff valve, a leak detector, a safety override, or a Ground Fault Interrupter.

The TWH Control System communicates bidirectionally with a Communications Module. This communications module may have wired, wireless, or both methods of communication with other systems, both locally and by network. In one embodiment, it communicates with other "smart" enabled devices on local circuits so that, based on user entered priorities for those other smart devices, power load is managed across multiple smart devices. This communication can be by modulating of the AC power lines within local circuits, dedicated wired lines such as RS232/485 or Cat 5 cable, or wireless such as Bluetooth, 900 MHz, 2.4 GHz, or other available wireless channels. Communications of this nature may be direct, between the TWH Communications Module and other smart devices, or routed through networks such as a Home Automation system, computers belonging to the user, WiFi, the cellular telephone network, or the Internet. Communications of this nature may be with the "cloud", a collection of computers, servers, storage devices, and/or processing devices accessible by the internet.

In a preferred embodiment, the smart devices a Communications Module may be communicating with may include other TWH systems which may be in use as "point of use" water heaters. Such devices are common when it is necessary to heat water locally somewhere distant from other locations where hot water may be needed, such as a kitchen sink vs. a bathroom shower. User entered priorities may decide which point of use water heater gets priority when multiple locations have demand for hot water.

In a preferred embodiment of this invention the Communications Module may communicate with a User Device such as a home computer, laptop, tablet, cell phone, or smart phone. This communication is preferably two way, such that the user can monitor performance of the Tankless Water Heater system, and control it or enter or change priorities as desired.

In an embodiment of this invention the Communications Module may communicate bidirectionally with a Diagnostics Center. The Diagnostics Centers may include, but are not limited to, the manufacturer, distributor, installer, or sales organization for the TWH system. In this way, the Diagnostics Center can see data logged by the TWH system, diagnose problems, and change operating parameters as needed, all remotely. This communication may take place by wire or wirelessly, and may use networks including the Internet or cell telephone system. As mentioned earlier, some permissions may be available for any of these Diagnostics Centers to change operating parameters or set points for the TWH system, while others may be available for the user. These permissions may or may not overlap between the user and various Diagnostics Center operators, and may be different among different Diagnostics Centers, such as, but not limited to, the manufacturer and the installer.

In an embodiment of this invention, the Communications Module would communicate bidirectionally with the power company. The power company could signal the unit to reduce or eliminate power usage, based on user entered preferences, in order to balance regional grid demand, in exchange for some credit on the user's power bill. The Communications Module could report to the power company actual power usage, since the user could potentially change their preferences, depending on the nature of their arrangements.

Figure 7:
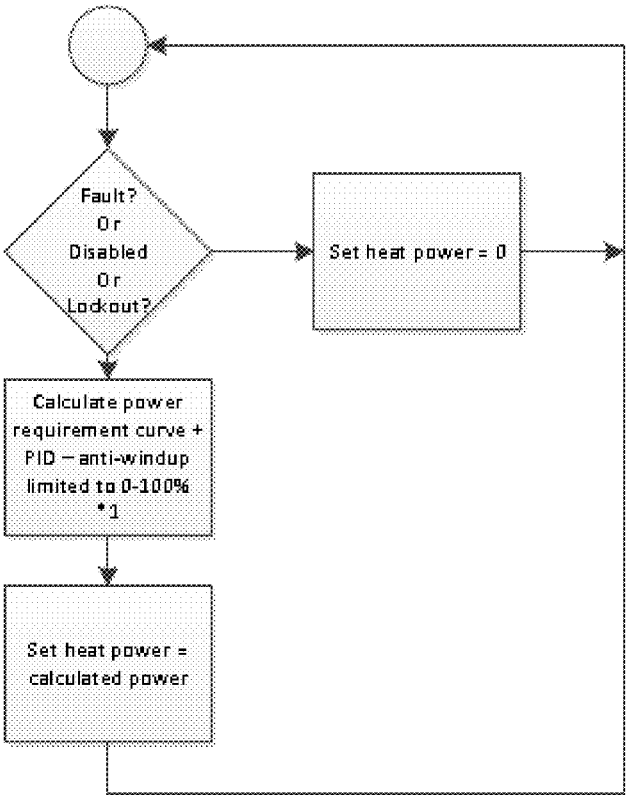
FIG. 7 illustrates an example of an outer loop control flowchart for the TWH Control System.

FIG. 7 shows an exemplary outer loop control flowchart for the TWH Control System. First, it evaluates whether the TWH is allowed to operate, or if it is in fault, disabled or lockout mode. Then it calculates a curve for the power requirements for the heater elements. This may use pre-established values for power factors for the heater elements. Other factors used in calculating the output power requirement include, but are not limited to, the input temperature, output temperature, flow rate, and the desired temperature set-point. An initial or "raw" estimate of power requirements is initially made based on fluid flow and temperature change needed at that flow rate. This raw estimate is updated using the output of a PID (Proportional/Integral/Derivative) control loop and an anti-windup factor, which fine tunes the estimate based on the real-time performance of the system. The refined power estimate is then limited to a range of 0-100%, and the resulting power set-point is stored for use by the instantaneous power control loop described later.

Figure 8:
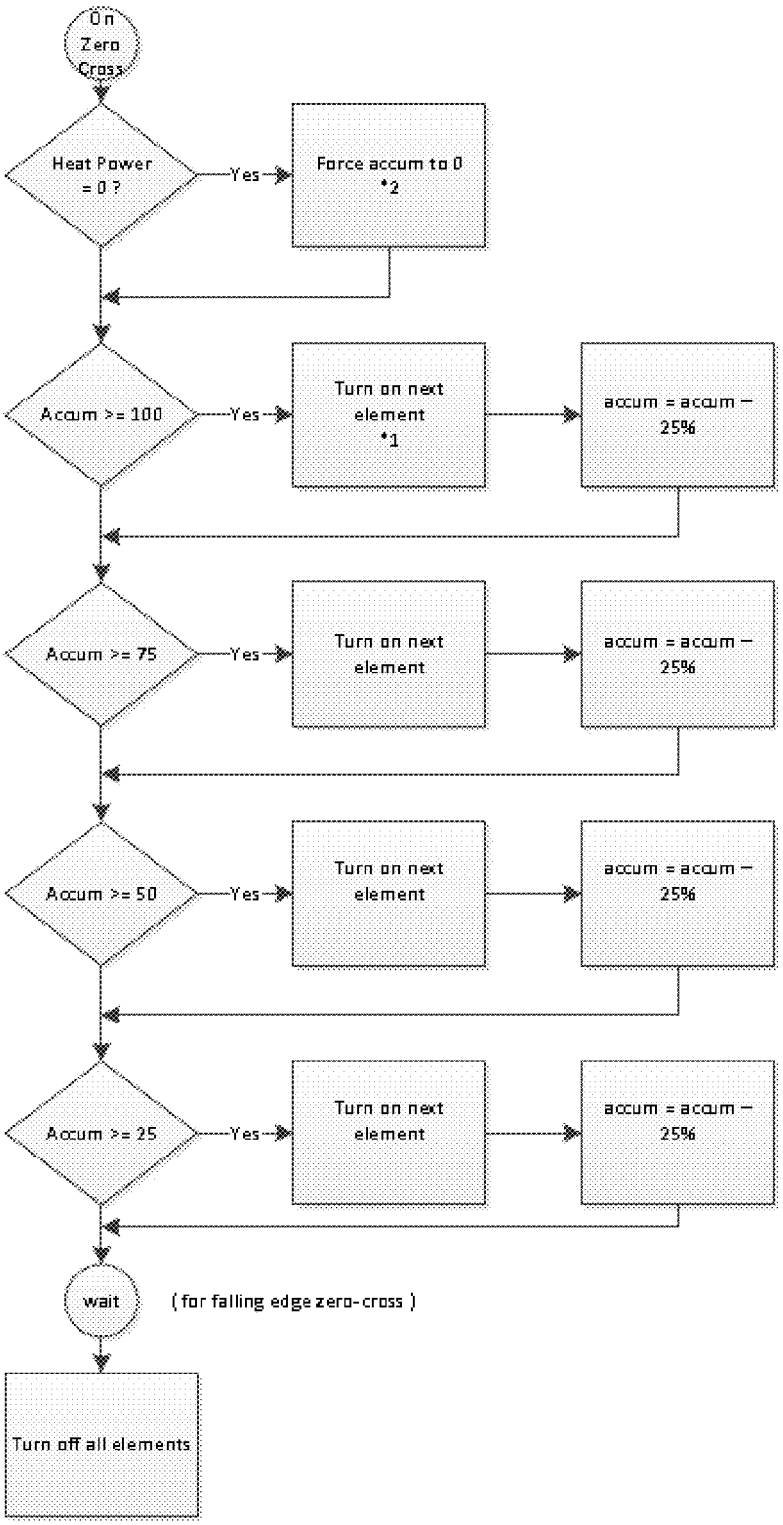
FIG. 8 illustrates the instantaneous power control loop for the heater elements which is iterated on every AC cycle.

FIG. 8 shows the instantaneous power control loop which is iterated on every AC cycle. Note that in this exemplary control loop four heater elements are assumed, so that 100% of the desired power is divided by four, giving 100, 75, 50 and 25 for the accumulator calculations. It is clear that this control concept can be utilized for any number of heating elements desired by dividing power appropriately. The power control begins on the zero crossing point of the input AC power cycle. It then, as shown, schedules heater elements to receive power in a "round robin" way in order to evenly distribute power and wear among all elements. Distributing power cycles to different heaters also reduces startup load of the overall system, which reduces flicker in power lines feeding the TWH system and other, nearby electrical systems. In an exemplary embodiment, forcing the accumulator to zero when the power set-point is zero provides immediate shut-off response, there is no need to bleed residual power requests which may have accumulated in the accumulator. In an exemplary embodiment, the power control loop may turn off all elements after ½ of a power control cycle. By waiting for the rising zero cross of the input AC power cycle to feed power to heating elements, and the falling edge zero-cross of the input AC power cycle to cut power to heating elements, interference, flicker and noise on the power circuit feeding the TWH is reduced. This is important since the electrical load of a typical TWH system is substantial enough to cause a significant disturbance on the AC power line feeding the system if it is switched in a noisy way.

It may also be appreciated that although only one set of heater tubes and electronics are referred to in the exemplary drawings and descriptions herein, it would be possible to have multiple, independent heater tubing sets in one enclosure with different fluids flowing through them. This might be applicable in the case where very different designs and heat profiles need to be used for a "multi-fluid" tankless heater system, or in the case where several pipes are in close proximity and it is easier or cheaper to have all the heater systems in one housing rather than in separate housings, thereby sharing control and data transmission electronics.

It will be clear that the described invention is well adapted to achieve the purposes described above, as well as those inherent within. The citation of any publication is for its disclosure prior to the filing date and should not be construed as an admission that the present invention is not entitled to antedate such publication by virtue of prior invention. Numerous other changes may be made which will readily suggest themselves to those skilled in the art and which are encompassed both in the spirit of the disclosure above and the appended claims.

What is claimed is:

1. An apparatus for heating a fluid which flows through the apparatus, the apparatus comprising:

a housing, containing a path through which fluid flows, the path in thermal contact with a heating system; and a sensor for monitoring either incoming or outgoing temperature of the fluid when the fluid is flowing; and a control system for the apparatus which includes a sensor capable of measuring a parameter directly related to the power supplied to the heating system, a logic processing circuit and a memory circuit such that operating parameters for the apparatus can be stored in the memory circuit and the apparatus can be controlled by the logic processing circuit and a communications module, the communications module communicating at least one of operational data and control instructions using a mutually compatible communications protocol for at least one way communication between the control system and at least one other device outside the apparatus.

2. An apparatus as defined in claim 1, wherein the heating system includes wires and a power supply and uses electricity to provide the heating of the fluid.

3. An apparatus as defined in claim 2, wherein the heating system is comprised of multiple resistance heaters and wherein the heating system applies an electrical current to the heaters in order to heat the fluid.

4. An apparatus as defined in claim 2, wherein the control system for the apparatus includes the ability to compensate for changing AC input voltage to the apparatus.

5. An apparatus as defined in claim 1, wherein the heating system burns liquid fuel to heat the fluid.

6. An apparatus as defined in claim 1, wherein the heating system burns gaseous fuel to heat the fluid.

7. An apparatus as defined in claim 1, wherein the communications module uses a mutually compatible communications protocol for two way communication between the control system and at least one other device outside the apparatus.

8. An apparatus as defined in claim 1, wherein the communications module communicates between the control system and at least one other device outside the apparatus while the apparatus is in operation.

9. An apparatus as defined in claim 1, wherein the communications module communicates by using a wired system.

10. An apparatus as defined in claim 1, wherein the communications module communicates by using a wireless system.

11. An apparatus as defined in claim 1, wherein the communications module communicates over the internet.

12. An apparatus as defined in claim 1, wherein the communications module communicates with either the servicer of the apparatus or the manufacturer of the apparatus while the apparatus is in operation, thereby updating at least one of operational data and control instructions in the apparatus.

13. An apparatus as defined in claim 1, wherein the communications module communicates while the apparatus is in operation with a user device, thereby updating at least one of operational data and control instructions in the apparatus.

14. An apparatus as defined in claim 1, wherein the communications module communicates with the power company while the apparatus is in operation, thereby updating at least one of operational data and control instructions in the apparatus.

15. An apparatus as defined in claim 1, wherein the communications module communicates with another fluid heating apparatus.

16. A method for controlling the heating of a fluid in a flow-through system, by placing a heating system in thermal contact with the path through which the fluid flows, comprising:

measuring at least one of incoming and outgoing temperature of the fluid, measuring flow rate of the fluid, measuring power supplied to the heating system by a sensor, calculating the amount of power needed to heat the fluid by a predetermined amount by using a control system, the control system carrying out the calculations by using a logic circuit and storing operational parameters in a memory circuit, adjusting the amount of power allowed to be applied according to at least one of operational data and control instructions from a communications module, the communications module communicating by either sending or receiving information in the form of at least one of operational data and control instructions from least one other device outside the apparatus and applying the adjusted amount of power to the heating system in order to heat the fluid.

17. A method as defined in claim 16, wherein electrically powering the heating system provides the heating of the fluid.

18. A method as defined in claim 16, wherein burning fuel powering the heating system provides the heating of the fluid.

19. A method as defined in claim 16, wherein the communications module allows two way information transfer between the control system and at least one other device outside the apparatus.

20. A method as defined in claim 16, wherein the communications module allows information transfer between the control system and at least one other device outside the apparatus while the apparatus is operating.

21. A method as defined in claim 16, wherein communicating takes place by a method chosen from the group of wired and wireless systems.

22. A method as defined in claim 16, wherein communicating takes place over the internet.

23. A method as defined in claim 16, wherein communicating takes place with an entity chosen from the group of a user device, the power company, the servicer of the apparatus or the manufacturer of the apparatus, thereby updating at least one of operational data and control instructions in the apparatus while the apparatus is in operation.

24. A method as defined in claim 16, wherein communicating with another fluid heating apparatus takes place for adjusting power.

25. A method as defined in claim 16, wherein the control system can adjust power to zero in response to input from the communications module.

26. An apparatus for heating a fluid in an apparatus, the apparatus comprising:

a tank, having an inlet and an outlet for the fluid, the fluid in the tank in thermal contact with a heating system; and a control system for the apparatus which includes a sensor capable of measuring a parameter directly related to the power supplied to the heating system, a logic processing circuit and a memory circuit such that operating parameters for the apparatus can be stored in the memory circuit and the apparatus can be controlled by the logic processing circuit and a communications module, the communications module communicating at least one of operational data and control instructions using a mutually compatible communications protocol for at least one way communication between the control system and at least one other device outside the apparatus.

27. An apparatus as defined in claim 26, wherein the heating system is electrically powered.

28. An apparatus as defined in claim 26, wherein the heating system is powered by burning fuel.

29. An apparatus as defined in claim 26, wherein the communications module uses a mutually compatible communications protocol for two way communication between the control system and at least one other device outside the apparatus.

30. An apparatus as defined in claim 26, wherein the communications module uses a mutually compatible communications protocol for communication between the control system and at least one other device outside the apparatus while the apparatus is operating.

31. An apparatus as defined in claim 26, wherein the communications module communicates by using either a wired or a wireless system.

32. An apparatus as defined in claim 26, wherein the communications module communicates over the internet.

33. An apparatus as defined in claim 26, wherein the communications module communicates with an entity chosen from the group of a user device, the power company, the servicer of the apparatus or the manufacturer of the apparatus, thereby updating at least one of operational data and control instructions in the apparatus while the apparatus is in operation.

34. An apparatus as defined in claim 26, wherein the communications module communicates with another fluid heating apparatus.

* * * * *